US009073615B2

(12) United States Patent
Kokkila

(10) Patent No.: US 9,073,615 B2
(45) Date of Patent: Jul. 7, 2015

(54) PROPULSION ARRANGEMENT IN A SHIP

(71) Applicant: ABB OY, Helsinki (FI)

(72) Inventor: Kimmo Kokkila, Helsinki (FI)

(73) Assignee: ABB OY, Helsinki (FI)

( * ) Notice: Subject to any disclaimer, the term of this patent is extended or adjusted under 35 U.S.C. 154(b) by 0 days.

(21) Appl. No.: 14/107,516

(22) Filed: Dec. 16, 2013

(65) Prior Publication Data

US 2014/0182501 A1 Jul. 3, 2014

Related U.S. Application Data

(63) Continuation of application No. PCT/EP2012/061189, filed on Jun. 13, 2012.

(30) Foreign Application Priority Data

Jun. 14, 2011 (EP) ..... 11169722

(51) Int. Cl.

| | |
|---|---|
| ***B63H 5/08*** | (2006.01) |
| ***B63H 1/04*** | (2006.01) |
| ***B63H 21/17*** | (2006.01) |
| ***B63H 25/38*** | (2006.01) |

(52) U.S. Cl.

CPC .. *B63H 5/08* (2013.01); *B63H 1/04* (2013.01); *B63H 21/17* (2013.01); *B63H 25/38* (2013.01)

(58) Field of Classification Search

CPC ..... B63H 5/08; B63H 1/04; B63H 25/38
USPC ..... 440/6, 1
See application file for complete search history.

(56) References Cited

U.S. PATENT DOCUMENTS 3,094,967 A * 6/1963 Willis, Jr. ..... 440/58
3,996,872 A * 12/1976 Pinchot, III ..... 114/280
5,417,597 A * 5/1995 Levedahl ..... 440/6

(Continued)

FOREIGN PATENT DOCUMENTS

EP 0590867 A1 4/1994
EP 1 574 425 9/2005

(Continued)

OTHER PUBLICATIONS

International Search Report (PCT/ISA/210) mailed on Oct. 9, 2012, by the European Patent Office as the International Searching Authority for International Application No. PCT/EP2012/061190.

(Continued)

*Primary Examiner* — Lars A Olson
*Assistant Examiner* — Jovon Hayes
(74) *Attorney, Agent, or Firm* — Buchanan Ingersoll & Rooney PC

(57) ABSTRACT

An exemplary propulsion arrangement is disclosed which includes two propulsion units situated side by side at the stern of a ship at opposite sides of a center line of the hull of the ship. Each propulsion unit can include a hollow support structure attached to the hull, a chamber attached to the support structure, an electric motor within the chamber, a propeller connected through a shaft to the electric motor, and a pivotably supported rudder at the rear end of the chamber. Each propulsion unit can be mounted in a toe-out position forming a horizontal tilt angle (β) of 0.5 to 6 degrees to the center line (CL) of the hull.

8 Claims, 3 Drawing Sheets

(56) References Cited

U.S. PATENT DOCUMENTS

| | | | | |
|---|---|---|---|---|
| 5,632,658 | A * | 5/1997 | Chen et al. | 440/49 |
| 6,322,406 | B1 | 11/2001 | Griffith, Sr. et al. | |
| 6,623,320 | B1 * | 9/2003 | Hedlund | 440/80 |
| 6,705,907 | B1 * | 3/2004 | Hedlund | 440/51 |
| 6,783,410 | B2 * | 8/2004 | Florander et al. | 440/51 |
| 7,033,234 | B2 * | 4/2006 | Arvidsson et al. | 440/1 |
| 2003/0166362 | A1 * | 9/2003 | Varis | 440/6 |
| 2003/0236036 | A1 | 12/2003 | Varis | |
| 2005/0170709 | A1 * | 8/2005 | Varis | 440/6 |
| 2005/0221692 | A1 | 10/2005 | Varis | |
| 2010/0064959 | A1 | 3/2010 | Huang | |
| 2012/0205352 | A1 | 8/2012 | Fermann | |
| 2014/0182501 | A1 * | 7/2014 | Kokkila | 114/163 |

FOREIGN PATENT DOCUMENTS

| | | | |
|---|---|---|---|
| GB | 221483 | A | 2/1925 |
| GB | 703777 | | 2/1954 |
| JP | 3-501714 | A | 4/1991 |
| JP | H06191484 | A | 7/1994 |
| JP | 2006-7937 | A | 1/2006 |
| JP | 2014-515175 | A | 6/2014 |
| KR | 20000048261 | A | 7/2000 |
| WO | 89/05262 | A1 | 6/1989 |
| WO | WO 98/54052 | A1 | 12/1998 |
| WO | WO 2009/126096 | A1 | 10/2009 |
| WO | 2010/022954 | A2 | 3/2010 |

OTHER PUBLICATIONS

European Search Report (EPO Form 1507N) mailed on Nov. 28, 2011.

International Search Report (PCT/ISA/210) mailed on Sep. 21, 2012, by the European Patent Office as the International Searching Authority for International Application No. PCT/EP2012/061189.

Office Action issued on Feb. 24, 2015, by the Japanese Patent Office in corresponding Japanese Patent Application No. 2014-515175. (4 pages).

* cited by examiner

PROPULSION ARRANGEMENT IN A SHIP

RELATED APPLICATION

This application claims priority as a continuation application under 35 U.S.C. §120 to PCT/EP2012/061189, which was filed as an International Application on Jun. 13, 2012 designating the U.S., and which claims priority to European Application 11169722.3 filed in Europe on Jun. 14, 2011. The entire contents of these applications are hereby incorporated by reference in their entireties.

FIELD

The present disclosure relates to a propulsion arrangement for mounting in a ship. An exemplary arrangement can be used in ships provided with two propulsion units situated side by side at the stern of the ship. The propulsion units are situated on opposite sides of the center line of a hull of the ship. Such a twin propulsion unit system is used, e.g., in passenger ships, passenger ferries, cargo ships, barges, oil tankers, ice breakers, off-shore ships and naval ships. Especially large ships such as cruisers, tankers transporting oil or liquefied natural gas, vehicle carriers, container ships and ferries use a twin propulsion unit system.

BACKGROUND INFORMATION

WO publication 98/54052 discloses a ship with twin propellers and twin Schilling rudders; i.e., a respective rudder for each propeller. Each rudder is pivotably mounted by a respective shaft, has a bulbous nose portion, a wasted mid-portion and a flared tail. The flared tail flares outwardly substantially only on the inner side of each rudder; i.e., the side which faces the other rudder pair.

Each rudder has an upper plate and a lower plate with the plates much more extensive on the inner side than on the outer side, the plates being aligned with streamlines from the respective propeller and the lower plate having a downwardly angled portion on the inner side. The rudders seem to form some kind of a toe-out angle in relation to the centerline of the hull.

U.S. Pat. No. 7,033,234 discloses a method for steering a planning V-bottomed boat with double individually steerable drive units with underwater housings, which extend down from the bottom of the boat. When running at planning speed straight ahead, the underwater housings are set with a so called toe-in angle; i.e., inclined towards each other with opposite angles of equal magnitude relative to the boat center line. When turning the boat, the inner drive unit is set with a greater steering angle than the outer drive unit.

JP Patent Publication 2006007937 discloses an arrangement in a ship with two pods with contra-rotating propellers situated at the stern of the ship. The first pod is in a first embodiment mounted stationary into the skeg so that the shaft line is inclined upwards. The second pod is fastened by a horizontal axis to a steering table, which steering table rotates around a vertical axis and which steering table can be lowered and raised by hydraulic cylinders. The shaft line of the second pod is aligned with the shaft line of the first pod. The rear end of the first pod is in a second embodiment fastened with a horizontal axis to the skeg and the front end of the first pod is fastened to a vertical cylinder. The inclination of the first pod can thus be adjusted with the cylinder. Both pods are in a third embodiment fastened to opposite ends of a common frame, which frame is supported from the middle part a horizontal axis to a steering table, which steering table rotates around a vertical axis and which steering table can be lowered and raised by hydraulic cylinders. There is no separate rudder in this arrangement and the steering of the ship is done by rotating either only the second pod situated after the first pod in the driving direction of the ship around a vertical axis or by rotating both pods around a vertical axis.

SUMMARY

A propulsion arrangement for a ship is disclosed, wherein the ship includes a hull having a center line (CL), the propulsion arrangement comprising: a stationary first propulsion unit for a port side of the center line (CL) at a stern of a hull; and a stationary second propulsion unit for a starboard side of the center line (CL) at a stern of a hull, said first and second propulsion units each including:

- a hollow support structure configured for attachment to a hull;
- a chamber having a front end and a read end, said chamber being attached to the support structure;
- an electric motor within the chamber;
- a shaft having a first end and a second end, said first end of the shaft being connected to the electric motor and said second end of the shaft protruding from the front end of the chamber and being connected to a propeller, said shaft forming a shaft line; and
- a pivotably supported rudder at the rear end of the chamber; wherein each propulsion unit is configured to be mounted so that the shaft line (SL) will form a horizontal tilt angle (β) in a range of 0.5 to 6 degrees with a center line (CL) of a hull so that the propulsion units will be situated in a toe-out position in relation to the center line (CL) of the hull with the front ends of the chambers inclined away from the center line (CL) of a ship and the rear ends of the chambers inclined towards the center line (CL) of a hull of the ship.

BRIEF DESCRIPTION OF THE DRAWINGS

Some exemplary embodiments of the invention are described in the following in detail with reference to the accompanying figures, in which.

DETAILED DESCRIPTION

Exemplary embodiments disclosed herein can improve propulsion arrangements based on two side by side propulsion units in ships.

An exemplary propulsion arrangement as disclosed herein which can include two propulsion units situated side by side at the stern of a ship at opposite sides of a center line of the hull of the ship. Each propulsion unit can include a hollow support structure attached to the hull, a chamber being attached to the support structure, an electric motor within the chamber, a propeller at the front end of the chamber, the propeller being connected through a shaft to the electric motor, and a pivotably supported rudder at the rear end of the chamber.

Each propulsion unit is, for example, mounted in a toe-out position forming an exemplary horizontal tilt angle of 0.5 to 6 degrees in relation to the center line of the hull. The front end of the chamber will thus be inclined away from the center line of the hull of the ship and the rear end of the chamber will be inclined towards the center line of the hull of the ship.

This toe-out arrangement of the propulsion units can improve the water inflow angle to the propellers, which can improve the efficiency of the propeller.

The toe-out arrangement also can reduce noise and vibrations, which are due to cavitation as the improved inflow angle to the propellers reduces cavitation.

The toe-out arrangement also can reduce shaft line vibrations and forces. This is due to the fact that there are less asymmetric forces acting on the propellers when the water inflow angle to the propellers is improved. Reduced loads and vibrations can increase the lifetime of the bearings of the shafts as well as other components affected by these vibrations and forces.

In an exemplary advantageous embodiment disclosed herein, the propulsion units are further tilted in the vertical plane so that the front end of the chamber is lower than the rear end of the chamber in relation to the water line. The vertical tilt angle of the propulsion units can further improve the water inflow angle to the propeller of the propulsion units thereby further improving the efficiency of the propulsion units.

Exemplary embodiments can be used in large ships provided with two propulsion units situated side by side at the stern of the ship, e.g., cruisers, tankers transporting oil or liquefied natural gas, vehicle carriers, container ships and ferries. The power of each propulsion unit in such large ships is, for example, on the order of at least 1 MW.

Figure 1:
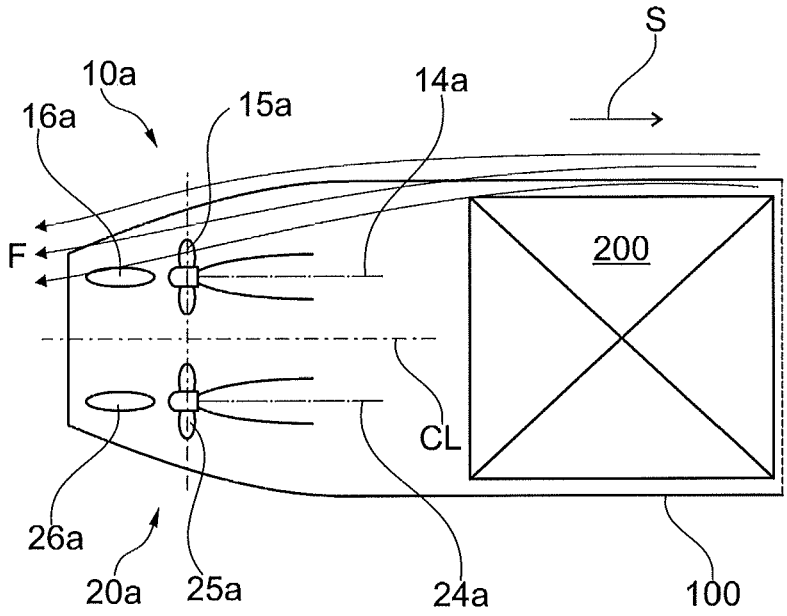
FIG. 1 shows a known propulsion arrangement.

FIG. 1 shows a known propulsion arrangement. The arrangement includes a twin propeller driving system 10*a*, 20*a* situated side by side at the stern of the ship.

Each driving system includes a propeller 15*a*, 25*a* driven by a shaft 14*a*, 24*a* and a rudder 16*a*, 26*a* situated after the propeller 15*a*, 25*a* in the driving direction S of the ship. The propellers 15*a*, 25*a* are situated on opposite sides of the centerline CL of the hull 100 of the ship. The first propeller 15*a* is driven by a first shaft 14*a* and the second propeller 25*a* is driven by a second shaft 24*a*, Each shaft 14*a*, 24*a* is driven by a main engine of its own (not shown in the figure).

A first rudder 16*a* is positioned after the first propeller 15*a* and a second rudder 26*a* is situated after the second propeller 25*a*. The propeller shafts 14*a*, 24*a* are parallel in relation to each other and also parallel in relation to the center line CL of hull 100 of the ship.

FIG. 1 also shows a cargo tank 200 for liquefied natural gas LNG. FIG. 1 shows that the position of the propellers 15*a*, 25*a* in relation to the stream lines F of the water flowing to the propellers 15*a*, 25*a* is not optimal.

Figure 2:
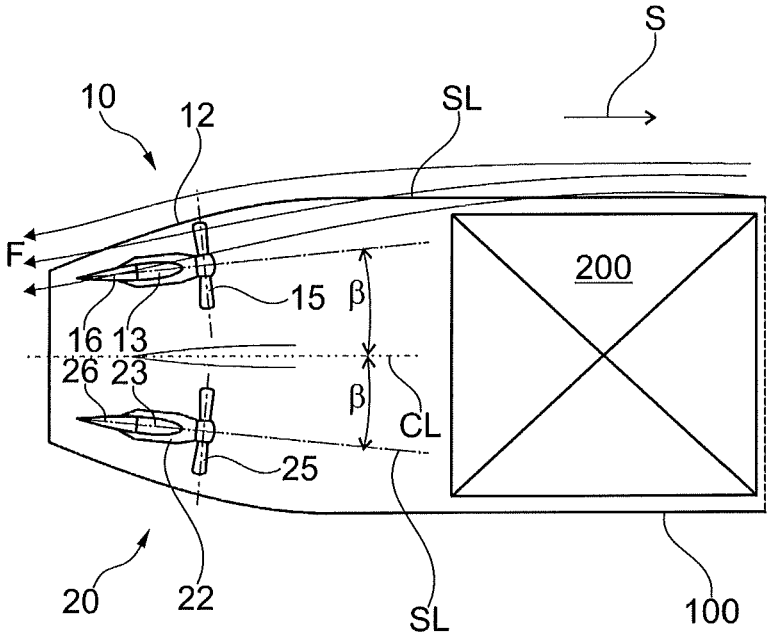
FIG. 2 shows an exemplary propulsion arrangement as disclosed herein.

FIG. 2 shows an exemplary propulsion arrangement according to the disclosure. The arrangement includes two propulsion units 10, 20 situated side by side at opposite sides of the center line CL of the hull 100 of the ship. Each propulsion unit 10, 20 includes a chamber 12, 22 connected with a support structure to the hull 100 of the ship.

A propeller 15, 25 situated at the front end of the chamber 12, 22 is driven by an electric motor 13, 23 positioned in the chamber 12, 22. A rudder 16, 26 is situated at the back end of the chamber 12, 22. The shaft lines SL of the propulsion units 10, 20 are arranged in a toe-out position in relation to the center line CL of the hull 100 of the ship. The shaft lines SL form a horizontal tilt angle β with the center line CL of the hull 100 of the ship so that the shaft lines SL will for example cross each other at a point on the center line CL of the hull of the ship, the crossing point being situated after the ship. The front end of the chambers 12, 22 is inclined outwards (toe-out position) in relation to the center line CL of the hull 100 of the ship and the back end of the chambers 12, 22 is inclined inwards in relation to the center line CL of the hull 100 of the ship.

FIG. 2 also shows a cargo tank 200 for liquefied natural gas LNG.

Figure 3:
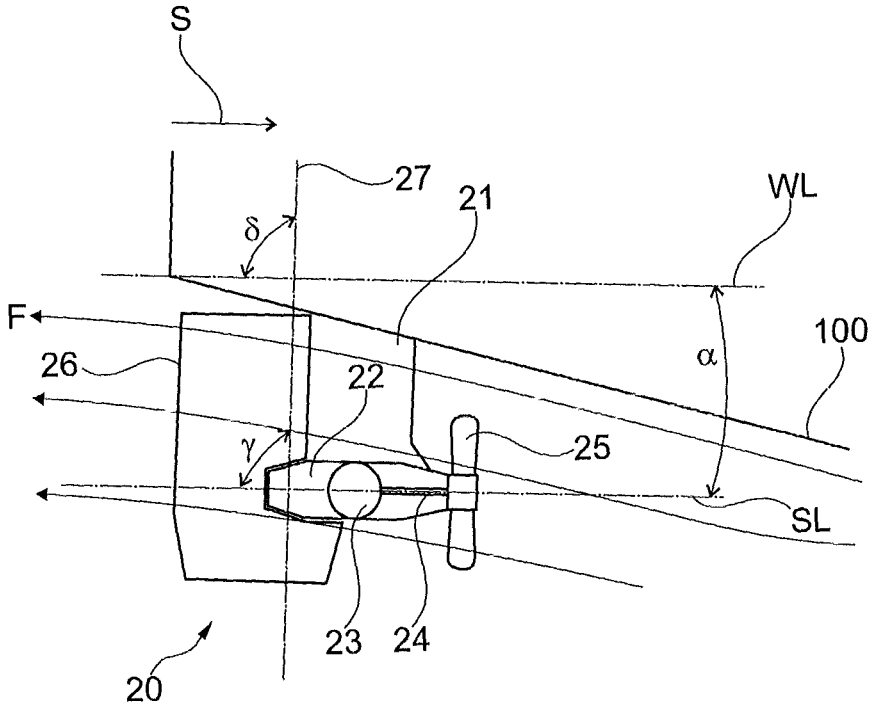
FIG. 3 shows a side view of an exemplary embodiment of a propulsion arrangement as disclosed herein.
Figure 4:
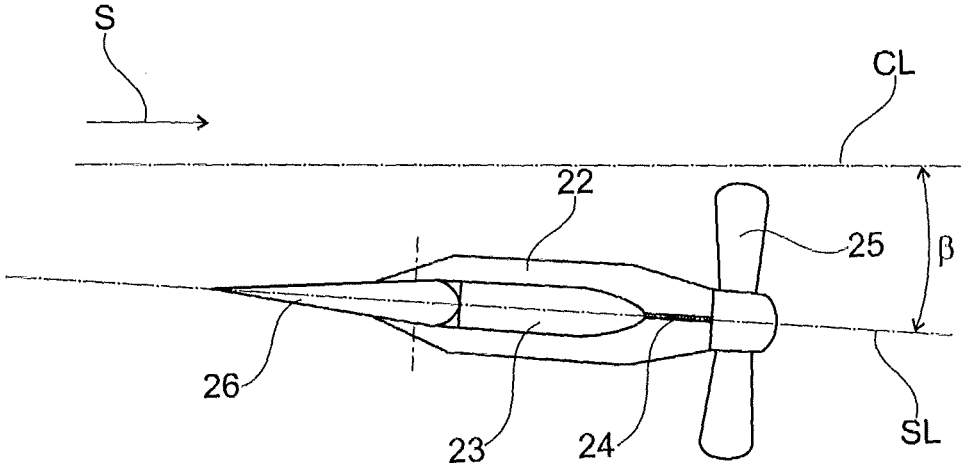
FIG. 4 shows a top view of an exemplary propulsion arrangement according to FIG. 3.

FIG. 3 shows a side view and FIG. 4 shows a top view of an exemplary embodiment of a propulsion arrangement according to the disclosure. FIGS. 3 and 4 show the arrangement of the starboard side propulsion unit 20 shown in FIG. 2. The port side propulsion unit 10 is identical to the starboard side propulsion unit except that the inclination is opposite so that the two propulsion units 10, 20 form mirror images of each other.

FIGS. 3 and 4 also show the driving direction S of the ship. FIG. 3 shows flow lines F of the water flowing to the propulsion unit 20.

The propulsion unit 20 includes a hollow support structure 21 connecting the propulsion unit 20 to the hull 100 of the ship, a chamber 22 having a front end and a rear end in relation to the driving direction S of the ship, the chamber 22 being connected to the support structure 21, an electric motor 23 within the chamber 22, a shaft 24 having a first end and a second end, the first end of the shaft 24 being connected to the rotor of the electric motor 23 and the second end of the shaft 24 protruding from the front end of the chamber 22 and being connected to a propeller 25. The electric motor 23 can be an induction motor or a synchronous motor.

The propulsion unit 20 can be fixed to the hull 100 of the vessel with the support structure 22. This means that the propeller 25 will remain in a fixed position in relation the hull 100 of the vessel all the time.

The shaft 14 forms a shaft line SL of the propulsion unit 20. The shaft line SL and the water line WL are parallel, which means that the vertical tilt angle α between them is for example 0 degrees. The angle between the axis 27 of the rudder 26 and the shaft line SL; i.e., the angle γ, is for example 90 degrees. The angle between the axis 27 of the rudder 26 and the water line WL; i.e., the angle δ, is also for example 90 degrees.

The steering of the ship can be done by a separate rudder 26, which is connected to the hull 100 of the ship and the propulsion unit 20 by means of an axis 27. The rudder 26 can thus be pivotably attached to the hull 100 and the propulsion unit 20. The rudder 26 is formed so that it forms a smooth continuation of the support structure 21 and the chamber 22. The lower part of the rudder 26 extends at a distance below the chamber 22.

A steering gear, which is not shown in FIG. 3, rotates the axis 27 and in this way also the rudder 26 based on the commands from the navigation bridge.

FIG. 4 shows that the shaft line SL of the exemplary propulsion unit 20 is further situated at a horizontal tilt angle β in relation to the centerline CL of the hull 100 of the ship. This means that the front side of the chamber 22 facing the propeller 25 can be inclined outwardly from the center line CL of the hull 100 of the ship and the back side of the chamber 22 facing the rudder 26 can be inclined inwardly towards the center line CL of the hull 100 of the ship. The propulsion unit 20 can thus be in a toe-out position in relation to the center line CL of the hull 100 of the ship.

The port side propulsion unit 10 forms a mirror image of the starboard side propulsion unit 20. The port side propulsion unit 10 can thus be also positioned in a toe-out position in relation to the center line CL of the hull 100 of the ship. The toe-out angle β is for example in a range of 0.5 to 6 degrees.

This toe-out arrangement of the propulsion units 10, 20 can improve the water inflow angle to the propellers 15, 25. This toe-out arrangement can improve efficiency, reduce vibrations and excitation in the hull 100 of the ship.

Figure 5:
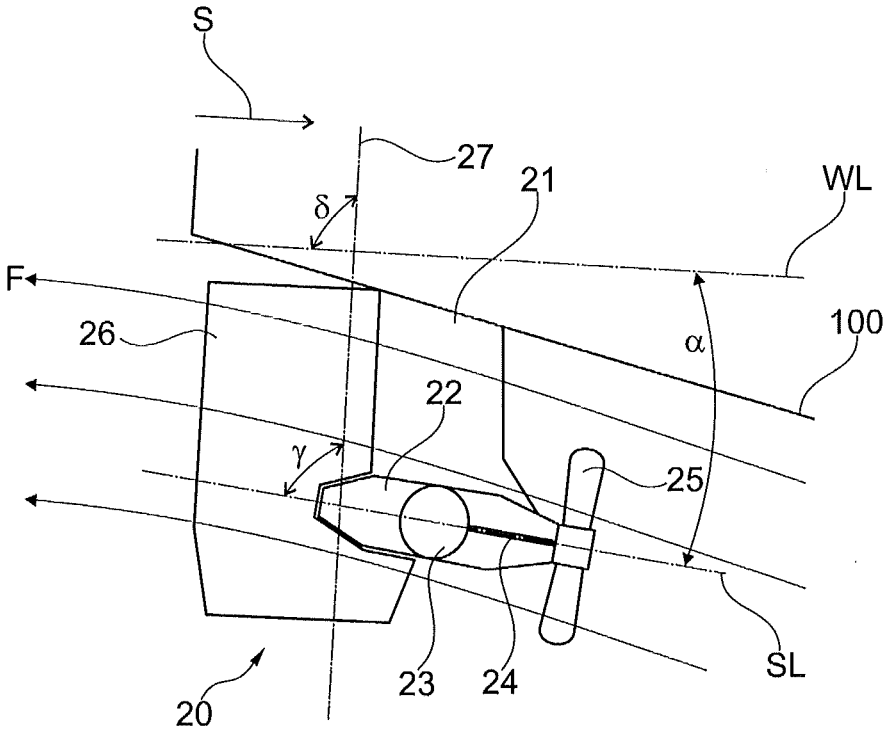
FIG. 5 shows a side view of another exemplary embodiment of a propulsion arrangement as disclosed herein.

FIG. 5 shows a side view of another exemplary embodiment of a propulsion arrangement according to the disclosure. The propulsion unit 20 corresponds as such to the propulsion unit shown in FIG. 3.

The difference compared to the arrangement shown in FIG. 3 is that the shaft line SL of the propulsion unit 20 forms a vertical tilt angle α in relation to the water line WL. This means that the front end of the chamber 22 is lower than the back end of the chamber 22 in relation to the water line WL. The angle of the water flow F entering the propeller 25 can be improved when the propulsion unit 20 is vertically tilted. This means that the hydrodynamic efficiency of the propeller 25 can be improved. The angle between the axis 27 of the rudder 26 and the water line WL; i.e., the angle δ is still for example 90 degrees as in FIG. 3. The angle between the axis 27 of the rudder 26 and the shaft line SL; i.e., the angle γ is, however, less than 90 degrees in this embodiment due to the vertical tilting of the propulsion unit 20.

FIG. 5 also shows the driving direction S of the ship.

Figure 6:
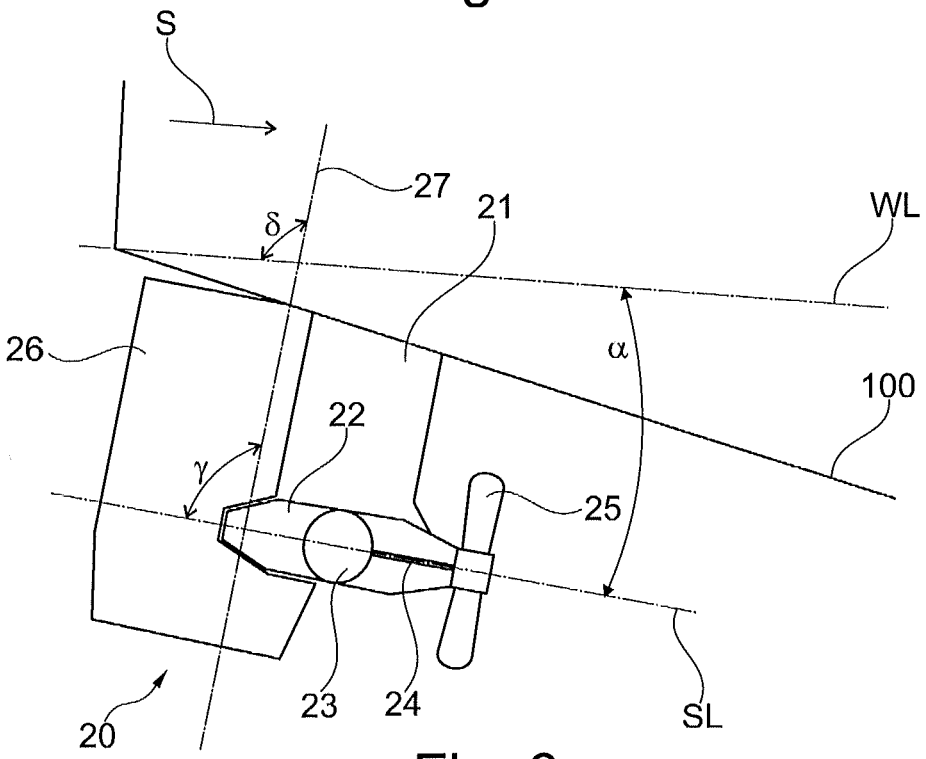
FIG. 6 shows a side view of an exemplary embodiment of a propulsion arrangement as disclosed herein.

FIG. 6 shows a side view of another exemplary embodiment of a propulsion arrangement according to the disclosure. This arrangement corresponds as such to that of FIG. 5; i.e., the propulsion unit 20 is tilted at an angle α in relation to the water line WL.

The difference is in the arrangement of the rudder 26. The angle between the axis 27 of the rudder 26 and the shaft line SL i.e. the angle γ is for example 90 degrees in this embodiment, which corresponds to the situation in FIG. 3. This means that the axis 27 of the rudder 26 has been tilted in relation to the water line WL; i.e., the angle δ is more than 90 degrees. The arrangement where the rudder 26 axis 27 forms a right angle with the shaft line SL is advantageous in respect of for example the flow generated by the propeller 25.

FIG. 6 also shows the driving direction S of the ship.

At least one generator (not shown in the figures) is provided within the hull 100 of the ship providing electric power to the electric motors 13, 23 in the propulsion units 10, 20 through an electric network (not shown in the figures).

The horizontal tilt angle β; i.e., the toe-out angle and the vertical tilt angle α can be determined separately for each ship or series of ships. An optimization of the horizontal tilt angle β and the vertical tilt angle α can be done based on a model test for each ship or series of ships. The optimization can be done separately for the horizontal tilt angle β and the vertical tilt angle α.

An exemplary goal in the optimization is to minimize the fuel consumption; e.g., to increase the efficiency. A best efficiency is for example achieved when the water inflow to the propellers is straight.

The separate rudder 26 is in the figures pivotably supported at the hull 100 and at the chamber 22 of the propulsion unit 20. The rudder 26 can be pivotably supported at the hull 100 and/or at the propulsion unit 20. The rudder 26 can thus be pivotably supported only at the hollow support structure 21, or at the hull 100 and the hollow support structure 21, or at the hull 100 and the chamber 22, or at the chamber 21 and the hollow support structure 21.

The examples of the embodiments of the present invention presented above are not intended to limit the scope of the invention only to these embodiments. Several modifications can be made to the invention within the scope of the claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A propulsion arrangement for a ship, wherein the ship includes a hull having a center line (CL), the propulsion arrangement comprising:

a stationary first propulsion unit for a port side of the center line (CL) at a stern of the hull; and a stationary second propulsion unit for a starboard side of the center line (CL) at a stern of the hull, said first and second propulsion units each including:

a hollow support structure configured for attachment to the hull;

a chamber having a front end and a read end, said chamber being attached to the support structure;

an electric motor within the chamber;

a shaft having a first end and a second end, said first end of the shaft being connected to the electric motor and said second end of the shaft protruding from the front end of the chamber and being connected to a propeller, said shaft forming a shaft line; and a pivotably supported rudder at the rear end of the chamber; wherein each propulsion unit is configured to be mounted so that the shaft line (SL) forms a horizontal tilt angle (β) in a range of 0.5 to 6 degrees with the center line (CL) of the hull so that each propulsion unit is respectively situated in a toe-out position in relation to the center line (CL) of the hull in which the front ends of the chambers are inclined away from the center line (CL) of the hull of the ship and the rear ends of the chambers are inclined towards the center line (CL) of the hull of the ship.

2. A propulsion arrangement according to claim 1, in combination with the ship, wherein each propulsion unit is mounted so that the shaft line (SL) forms a vertical tilt angle (α) in a range of 1 to 8 degrees in relation to the water line (WL) so that the front end of the chamber is lower than the rear end of the chamber in relation to the water line (WL).

3. A propulsion arrangement according to claim 2, wherein the ship is a cruiser, a tanker transporting oil or liquefied natural gas, a vehicle carrier, a container ship or a ferry.

4. A propulsion arrangement according to claim 1, wherein a power of each propulsion unit is at least 1 MW.

5. A propulsion arrangement according to claim 1, in combination with the ship.

6. A propulsion arrangement according to claim 5, wherein the ship is a cruiser, a tanker transporting oil or liquefied natural gas, a vehicle carrier, a container ship or a ferry.

7. A propulsion arrangement according to any of claim 2, wherein a power of each propulsion unit is at least 1 MW.

8. A propulsion arrangement according to any of claim 3, wherein a power of each propulsion unit is at least 1 MW.

* * * * *